US011554908B2

(12) United States Patent
Maccario

(10) Patent No.: US 11,554,908 B2
(45) Date of Patent: Jan. 17, 2023

(54) COMBINATION DISPENSING AND SIDE DISPOSAL CONTAINER AND METHOD

(71) Applicant: Susan C. Maccario, Naples, FL (US)

(72) Inventor: Susan C. Maccario, Naples, FL (US)

( * ) Notice: Subject to any disclaimer, the term of this patent is extended or adjusted under 35 U.S.C. 154(b) by 0 days.

(21) Appl. No.: 17/691,330

(22) Filed: Mar. 10, 2022

(65) Prior Publication Data

US 2022/0289466 A1 Sep. 15, 2022

Related U.S. Application Data

(60) Provisional application No. 63/159,193, filed on Mar. 10, 2021.

(51) Int. Cl.

| | |
|---|---|
| ***B65D 83/08*** | (2006.01) |
| ***A47K 10/42*** | (2006.01) |
| *A47K 10/32* | (2006.01) |
| *B31B 50/26* | (2017.01) |
| *B31B 120/25* | (2017.01) |

(52) U.S. Cl.

CPC ..... *B65D 83/0888* (2013.01); *A47K 10/421* (2013.01); *B65D 83/0805* (2013.01); *A47K 2010/3233* (2013.01); *A47K 2010/3266* (2013.01); *B31B 50/26* (2017.08); *B31B 2120/25* (2017.08)

(58) Field of Classification Search

CPC ..... B65D 83/0888; B65D 83/0805; B65D 83/0823; B65D 83/0894; A47K 10/421; B31B 50/26; B31B 2120/25

USPC ..... 220/503; 221/34

See application file for complete search history.

(56) References Cited

U.S. PATENT DOCUMENTS

| | | | |
|---|---|---|---|
| D4,756 | S | 4/1871 | Kirchner |
| D4,759 | S | 4/1871 | Kirchner |
| D19,516 | S | 12/1889 | Sawyer |
| D25,856 | S | 8/1896 | Helmer |
| D42,500 | S | 5/1912 | Claussen et al. |
| 1,988,939 | A | 1/1935 | Craig |
| 2,415,588 | A | 2/1947 | Gui |
| 2,915,218 | A | 12/1959 | Rosenman et al. |
| 3,001,645 | A | 9/1961 | Hernberg |
| 3,021,977 | A | 2/1962 | Hester |

(Continued)

FOREIGN PATENT DOCUMENTS

DE 10061670 A1 6/2002

*Primary Examiner* — Steven A. Reynolds

(74) *Attorney, Agent, or Firm* — Jacob M. Ward; Ward Law Office LLC

(57) ABSTRACT

The present invention fulfills the above and other objects by providing a combination dispensing and disposal container having a dispensing end with a dispensing opening for dispensing new items, such as facial tissue, wet wipes, candy, etc. On the side of the container is a disposal opening for accepting trash. A partition located inside of the container separates a storage compartment where new items are held from a disposal compartment where trash is held. The combination dispensing and disposal container is usable for individual personal use, provides an all-in-one convenient box for separated new items form used items, and can be used anywhere. The entirety of the combination dispensing and disposal container may be discarded into the trash or recycled upon the disposal compartment being filled with used items.

7 Claims, 6 Drawing Sheets

(56) References Cited

U.S. PATENT DOCUMENTS

| | | | | |
|---|---|---|---|---|
| 3,095,087 | A | 6/1963 | Yates | |
| 3,221,928 | A | 12/1965 | Horn | |
| 3,331,498 | A | 7/1967 | Davies | |
| 3,468,467 | A | 9/1969 | Amberg | |
| 3,471,075 | A | 10/1969 | Wolf | |
| D223,703 | S | 5/1972 | Hester | |
| D223,704 | S | 5/1972 | Amberg | |
| D232,932 | S | 9/1974 | Stahel, II | |
| 3,915,296 | A | 10/1975 | Spencer | |
| 3,985,837 | A | 10/1976 | Rock | |
| D248,916 | S | 8/1978 | Reynolds et al. | |
| 4,440,835 | A | 4/1984 | Vignaud | |
| D273,651 | S | 5/1984 | Emrick | |
| 4,879,442 | A | 11/1989 | Giovine | |
| 4,919,302 | A | 4/1990 | McPherson | |
| 5,054,612 | A | 10/1991 | Meyer, Jr. | |
| 5,129,545 | A | 7/1992 | Parks | |
| D353,995 | S | 1/1995 | Foster | |
| D369,971 | S | 5/1996 | Brauner et al. | |
| 5,530,763 | A | 6/1996 | Aebi et al. | |
| D400,397 | S | 11/1998 | Stephan | |
| 5,944,219 | A | 8/1999 | Emoff et al. | |
| 6,321,937 | B1 | 11/2001 | DeSimone et al. | |
| 6,371,296 | B1 | 4/2002 | Rumbough | |
| 6,427,839 | B1 | 8/2002 | Helfer-Grand | |
| 6,439,386 | B1 * | 8/2002 | Sauer | B65D 5/4208 221/45 |
| 6,648,172 | B2 * | 11/2003 | Leighton | A47K 10/424 221/48 |
| 6,672,474 | B2 | 1/2004 | May et al. | |
| 6,675,986 | B1 | 1/2004 | Spencer | |
| 6,702,147 | B2 | 3/2004 | Ashford | |
| 6,863,192 | B2 | 3/2005 | Tumlinson | |
| D515,437 | S | 2/2006 | Lopez-Garcia | |
| 7,073,684 | B2 | 7/2006 | Decker et al. | |
| 7,357,274 | B2 | 4/2008 | Hewett | |
| 7,380,687 | B2 | 6/2008 | FitzSimons et al. | |
| 7,490,734 | B2 * | 2/2009 | Carr | A47K 10/46 221/92 |
| D623,961 | S | 9/2010 | Maccario | |
| 8,752,729 | B2 | 6/2014 | Maccario | |
| 2002/0121451 | A1 | 9/2002 | Subramanian et al. | |
| 2003/0178336 | A1 | 9/2003 | Zomorodi et al. | |
| 2003/0178436 | A1 | 9/2003 | Ashford | |
| 2003/0189059 | A1 | 10/2003 | May et al. | |
| 2006/0101564 | A1 | 5/2006 | Powdermaker | |
| 2007/0062966 | A1 | 3/2007 | Mark et al. | |
| 2007/0272694 | A1 | 11/2007 | May et al. | |
| 2008/0169304 | A1 | 7/2008 | Fino et al. | |
| 2010/0126998 | A1 | 5/2010 | Wilson et al. | |
| 2018/0228321 | A1 * | 8/2018 | Kurker | B65F 1/1426 |

* cited by examiner

COMBINATION DISPENSING AND SIDE DISPOSAL CONTAINER AND METHOD

CROSS-REFERENCE TO RELATED APPLICATIONS

This application claims the benefit of U.S. Provisional Application No. 63/159,193, filed on Mar. 10, 2021. The entire disclosure of the above application is incorporated herein by reference.

FIELD

This invention relates to containers, more particularly, a container having multiple compartments, which are separated by a bladder and/or a partition, for holding and dispensing of new items, such as tissues, moist towelettes, wrapped candy, and disposing of trash, such as used tissues, used moist towelettes, candy wrappers and so forth.

INTRODUCTION

This section provides background information related to the present disclosure which is not necessarily prior art.

Most containers for items, such as tissues, moist towelettes, wrapped candy, etc., are commonly cardboard boxes having an opening on the top for dispensing the items that are contained therein. A problem with current containers is that they do not provide a means for disposing of trash, such as used tissues, used moist towelettes, candy wrappers, etc. This poses a problem especially in places where a trash can is not easily accessible, such as in a car, airplane, movie theater, classroom, etc. Furthermore, this especially poses a problem with personal hygiene items, such as tissues and wet wipes, because the germs, bacteria and/or viruses contained in used personal hygiene items can pose a health risk to others if these items are not disposed of properly.

A combination dispensing and disposal container known in the art is described in the co-owned U.S. Pat. No. 8,752,729, filed on Oct. 9, 2009 and issued on Jun. 17, 2014, the entire disclosure of which is hereby incorporated herein by reference. The known combination dispensing and disposal container has a dispensing end with a dispensing opening for dispensing new items, such as facial tissue, wet wipes, candy, etc. On the opposite end of the container is a disposal end with a disposal opening for accepting trash. A bladder is located inside of the container and separates a storage compartment where new items are held from a disposal compartment where trash is held. In addition to or in lieu of a bladder, a rigid partition may also separate the storage compartment from the disposal compartment. One or more lids keeps the dispensing and end and the disposal end sealed when not in use.

There is a continuing need for a container having multiple compartments for holding new items, such as tissues, moist towelettes, wrapped candy, etc., and disposing of trash, such as used tissues, used moist towelettes, candy wrappers, etc. Desirably, the container is convenient to use and functional for both holding new items and disposal of trash.

SUMMARY

In concordance with the instant disclosure, a container having multiple compartments for holding new items, such as tissues, moist towelettes, wrapped candy, etc., and disposing of trash, such as used tissues, used moist towelettes, candy wrappers, etc., and which is convenient to use and functional for both holding new items and disposal of trash, has been surprisingly discovered.

The primary object of the present invention is to provide a combination dispensing and disposal container that stores both new and used items.

Another object of the present invention is to provide a combination dispensing and disposal container that prevents the spread of germs, bacteria and/or viruses contained in used personal hygiene items.

An even further object of the present invention is to provide a combination dispensing and disposal container that is easy to carry.

An even further object of the present invention is to provide a combination dispensing and disposal container that can be personalized in order to easily identify the owner of the combination dispensing and disposal container.

The present invention fulfills the above and other objects by providing a combination dispensing and disposal container that is preferably substantially cuboid in shape (i.e., box-shaped in form) with the waste compartment placed on a side of the cuboid form.

The combination dispensing and disposal container may be used with a variety of items. For example, new tissues may be stored in the storage compartment and used tissue may be place in the waste compartment. Alternatively, items such as wrapped candies may be stored in the storage compartment and the wrappers from the candies may be placed in the waste compartment.

In one embodiment, a combination dispensing and disposal container may include a main body folded to a cuboid shape. The cuboid shape has a height, a length, and a width. The main body has a top panel, a front panel, a bottom panel, a rear panel, at least one first side panel, at least one second side panel, and a partition panel. The main body has a storage compartment and a waste compartment separated by the partition panel. A dispensing opening may be formed in the top panel of the main body and is in communication with the storage compartment. The dispensing opening permits for a dispensing of new items from the storage compartment through the dispensing opening. A disposal opening may be formed in the front panel of the main body and is in communication with the waste compartment. The disposal opening permits for a disposal of used items into the waste compartment through the disposal opening.

In another embodiment, a folding blank for the combination dispensing and disposal container may include a main body configured to be folded to a cuboid shape. The main body has a top panel, a front panel, a bottom panel, a rear panel, at least one first side panel, at least one second side panel, and a partition panel. The main body of the folding blank is configured to have a storage compartment and a waste compartment separated by the partition panel upon the main body being folded to the cuboid shape.

In a further embodiment, a method for constructing a combination dispensing and disposal container includes a step of providing the folding blank the combination dispensing and disposal container. The at least one first side panel of the folding blank includes a bottom side panel and a partition support panel, and the partition panel is disposed between and connecting the bottom side panel and the partition support panel. The method further includes a step of folding the partition panel inwardly from an unfolded position so that the partition panel is disposed between the top panel and the bottom panel. The method also includes a step of folding the partition support panel downwardly from an unfolded position so that the partition support panel is disposed adjacent second side panel and abuts the bottom panel to support the partition panel above the bottom panel. The method additionally includes a step of folding a remainder of the folding blank to form the main body into the cuboid shape.

Further areas of applicability will become apparent from the description provided herein. It should be understood that the description and specific examples are intended for purposes of illustration only and are not intended to limit the scope of the present disclosure.

DRAWINGS

The drawing described herein is for illustrative purposes only and is not intended to limit the scope of the present disclosure in any way.

Figure 1:
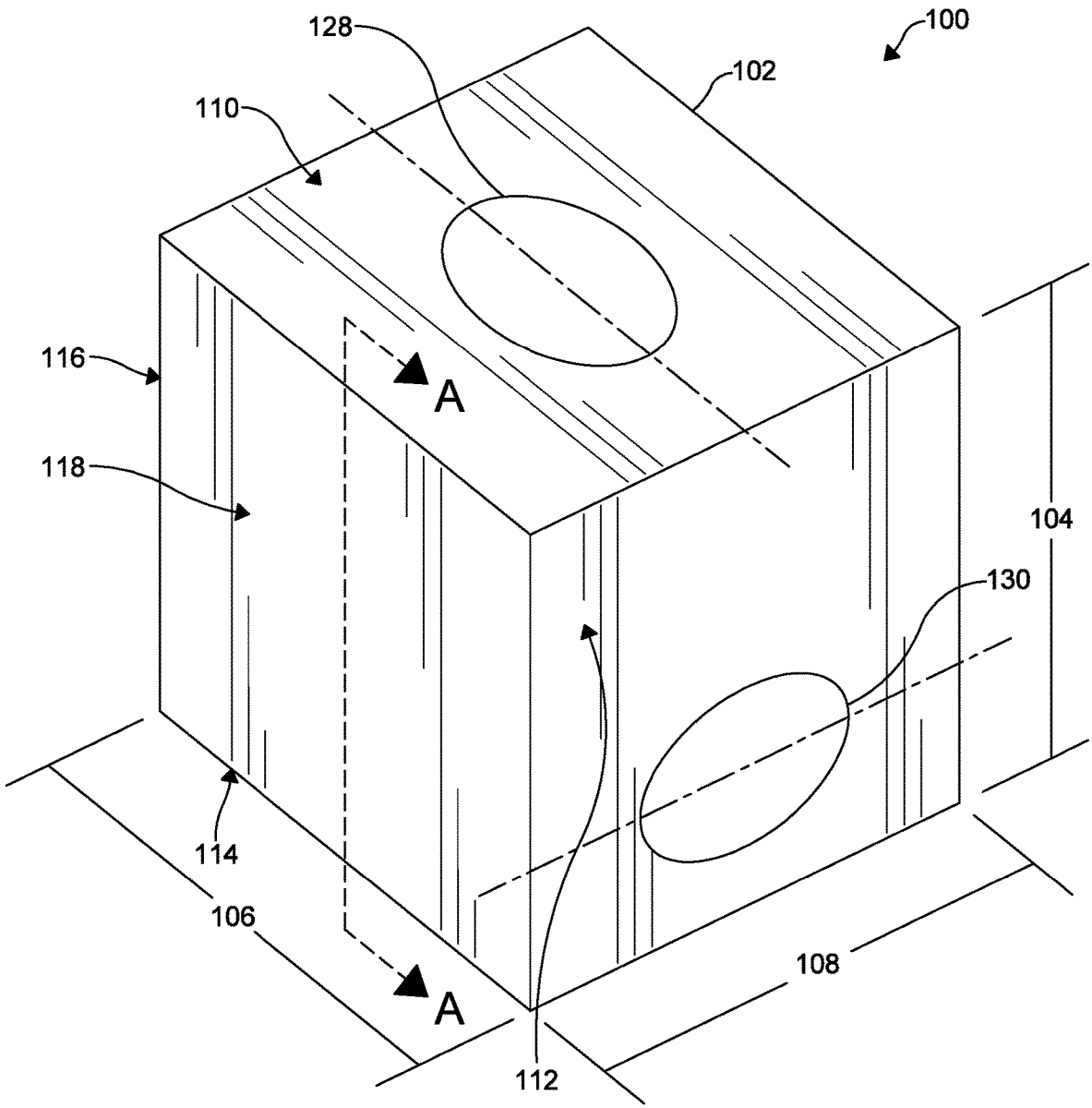
FIG. 1 is a top perspective view of a combination dispensing and disposal container according to one embodiment of the present disclosure, having a cuboid or box-shape and with the disposal container accessed from a front panel of the combination dispensing and disposal container, according to one embodiment of the present disclosure.
Figure 6:
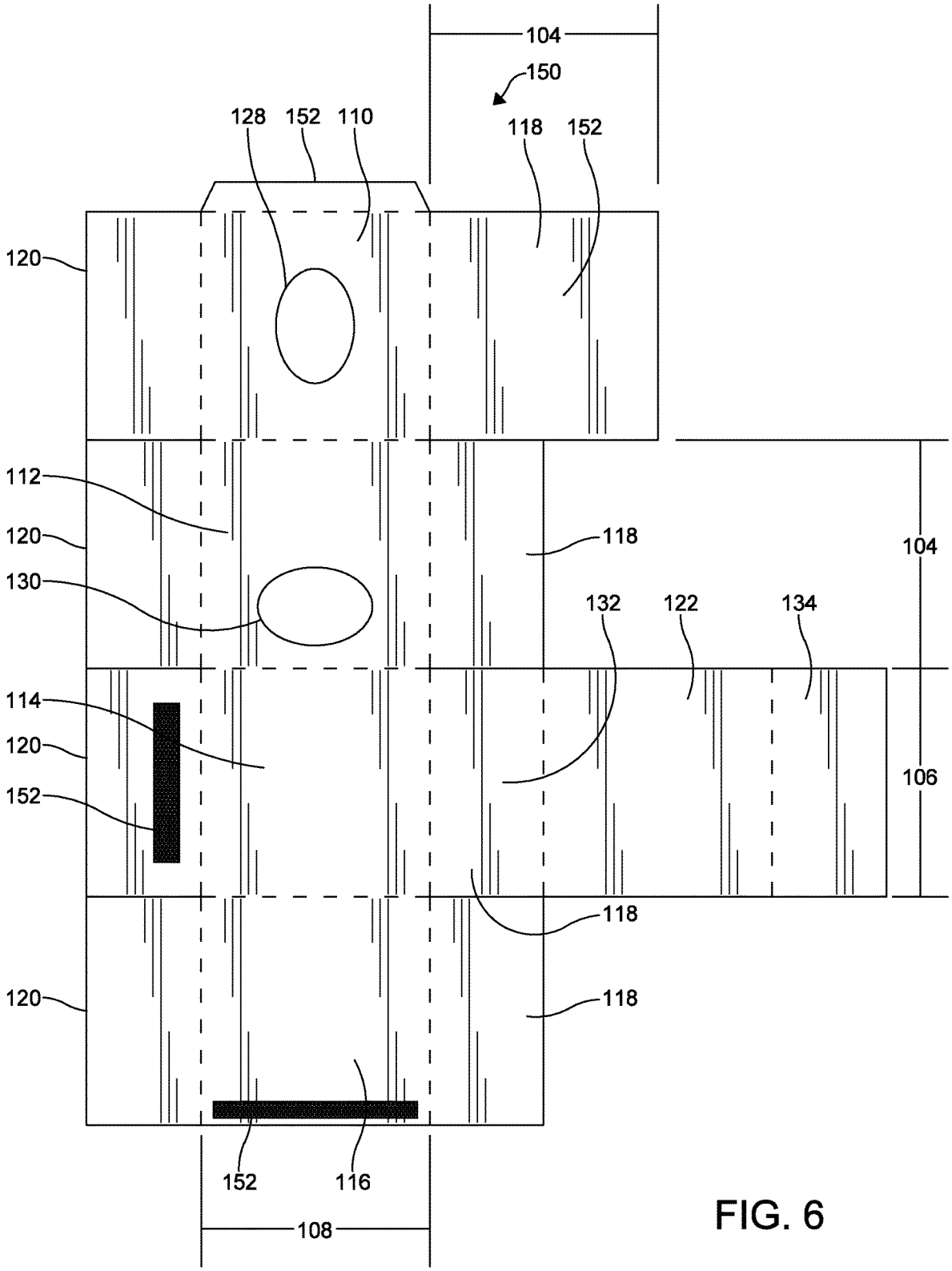
Figure 7:
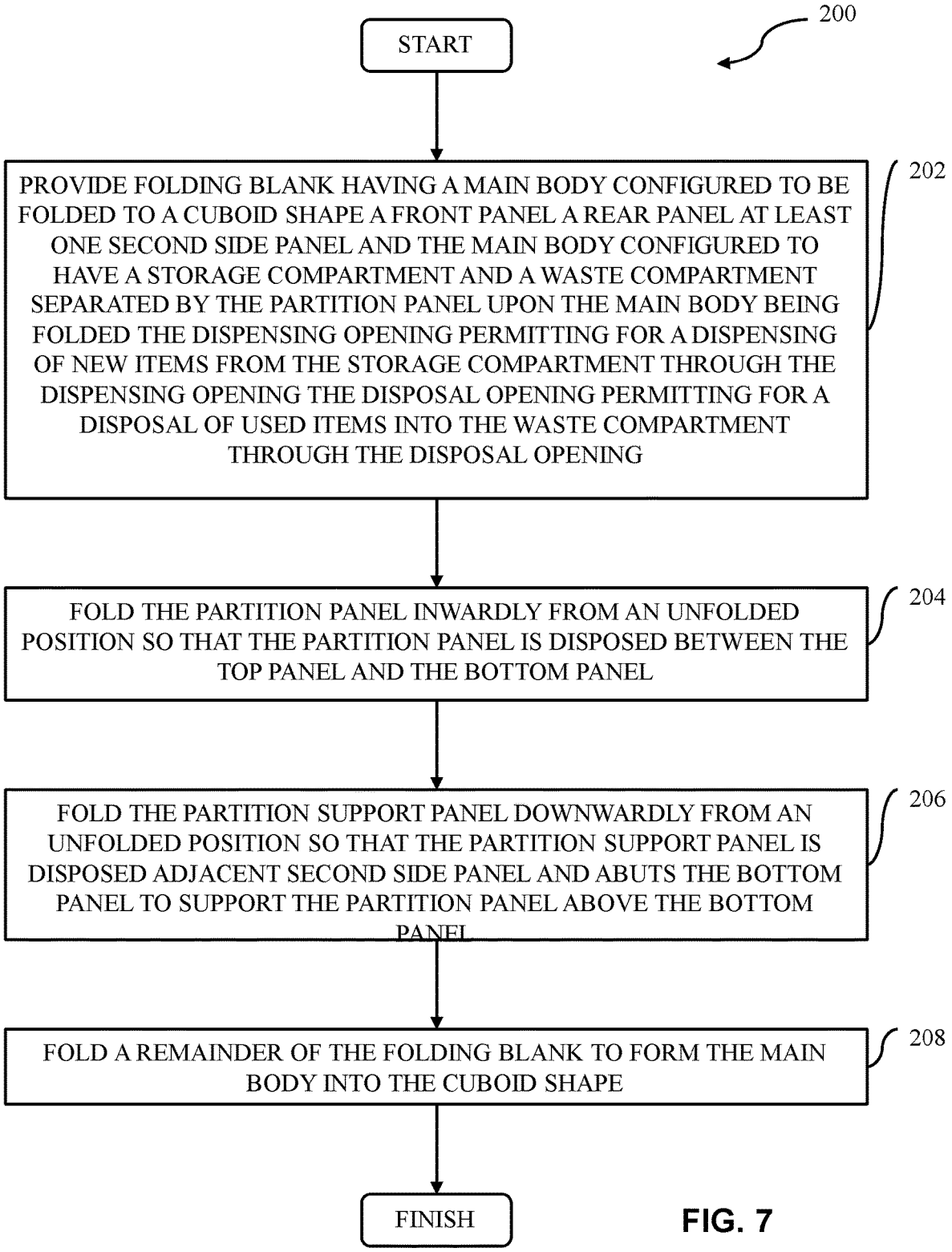

FIG. 6 is a top plan view of a folding blank for constructing the combination dispensing and disposal container shown in FIG.1, with folding lines shown in phantom or dashed lines, according to one embodiment of the present disclosure; and FIG. 7 is a flow diagram illustrating a method for constructing the combination dispensing and disposal container shown in FIG. 1, according to one embodiment of the present disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a process reciting elements A, B and C specifically envisions embodiments consisting of, and consisting essentially of, A, B and C, excluding an element D that may be recited in the art, even though element D is not explicitly described as being excluded herein.

As referred to herein, all disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "folding blank" refers to box blanks, most desirably made of paper or corrugated cardboard. The box blanks are folded to form folded boxes.

As used herein, the term "folding line" refers to a line or mark made by folding or doubling a pliable substance. However, it should be appreciated that a skilled artisan may employ a mechanical bearing, such as a hinge, to substitute the folding operation, as desired.

As used herein, the term "panel" may refer to sections of the main body or may include separate pieces affixed to the main body.

The present technology improves upon a known combination dispensing and disposal container as described in the co-owned U.S. Pat. No. 8,752,729, filed on Oct. 9, 2009 and issued on Jun. 17, 2014, the entire disclosure of which is hereby incorporated herein by reference.

As shown in FIGS. 1-5, a combination dispensing and disposal container 100 includes a main body 102 folded to a cuboid shape. The cuboid shape of the main body 102 has a height 104, a length 106, and a width 108. In a particular example, the height 104 may be about five and three-eighths inches (5.375"), the length may be about four and five-eighths inches (4.625"), and the width may be about four and three-eighths inches (4.375"). A thickness of each of the panels forming the combination dispensing and disposal container 100 may also be about one-quarter inches (0.25"). Advantageously, the combination dispensing and disposal container 100 may have dimensions that are similar or the same as conventional cuboid tissue boxes that are commercially available and familiar to consumers. One of ordinary skill in the art may also select other suitable dimensions for the cuboid shape of the main body 102, within the scope of the present disclosure.

Figure 5:
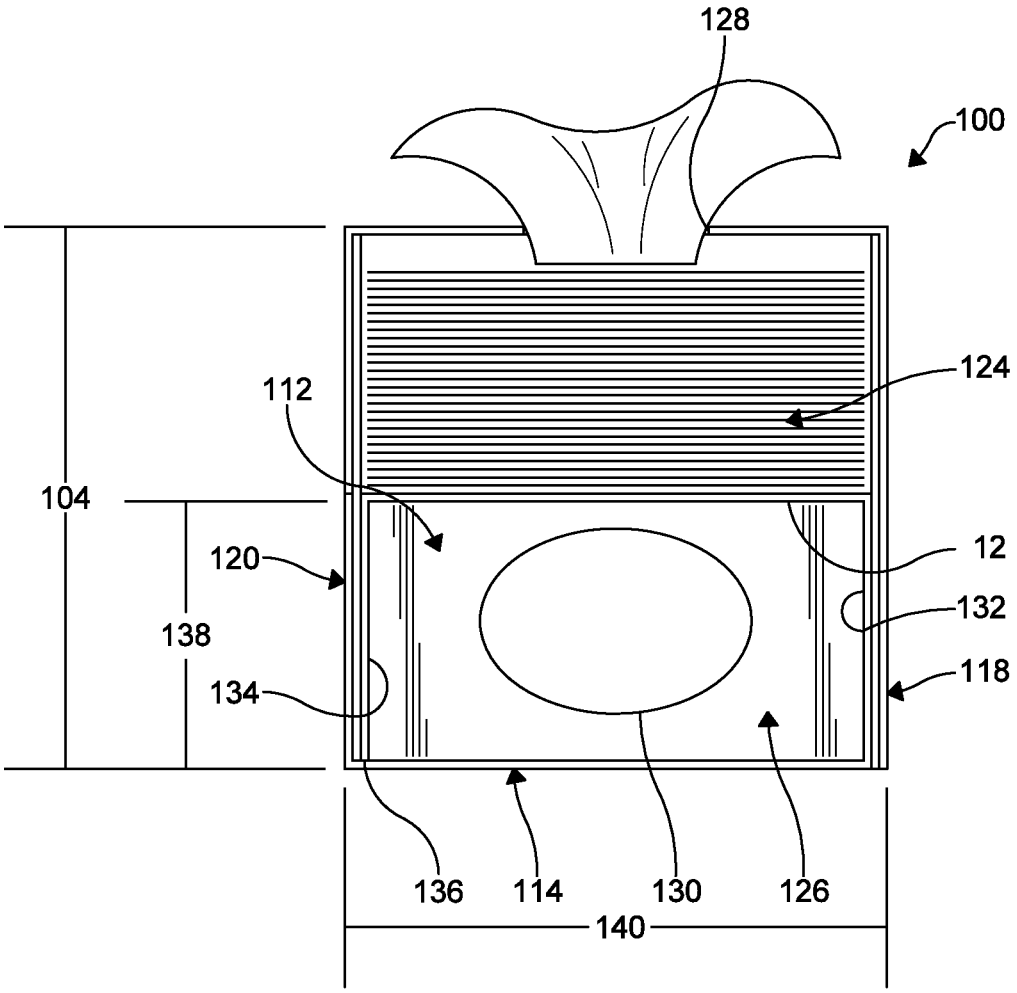
FIG. 5 is a cross-sectional elevational view of the combination dispensing and disposal container taken along section line A-A in FIG. 1, and showing a partition panel separating a dispensing compartment and a waste compartment of the combination dispensing and disposal container.

Referring to FIGS. 1-5, the main body 102 may further have a top panel 110, a front panel 112, a bottom panel 114, a rear panel 116, at least one first side panel 118, at least one second side panel 120, and a partition panel 122 (shown in FIG. 5). As also shown in FIG. 5, the main body 102 further has a storage compartment 124 and a waste compartment 126 separated by the partition panel 122.

With renewed reference to FIGS. 1-5, the main body 102 further may have a dispensing opening 128 and a disposal opening 130. The dispensing opening 128 is formed in the top panel 110 of the main body 102. The dispensing opening 128 is in communication with the storage compartment 124. The dispensing opening 128 permits for a dispensing of new items from the storage compartment 124 through the dispensing opening 128. The disposal opening 130 is formed in the front panel 112 of the main body 102. The disposal opening 130 is in communication with the waste compartment 126. The disposal opening 130 permits for a disposal of used items into the waste compartment 126 through the disposal opening 130.

Figure 2:
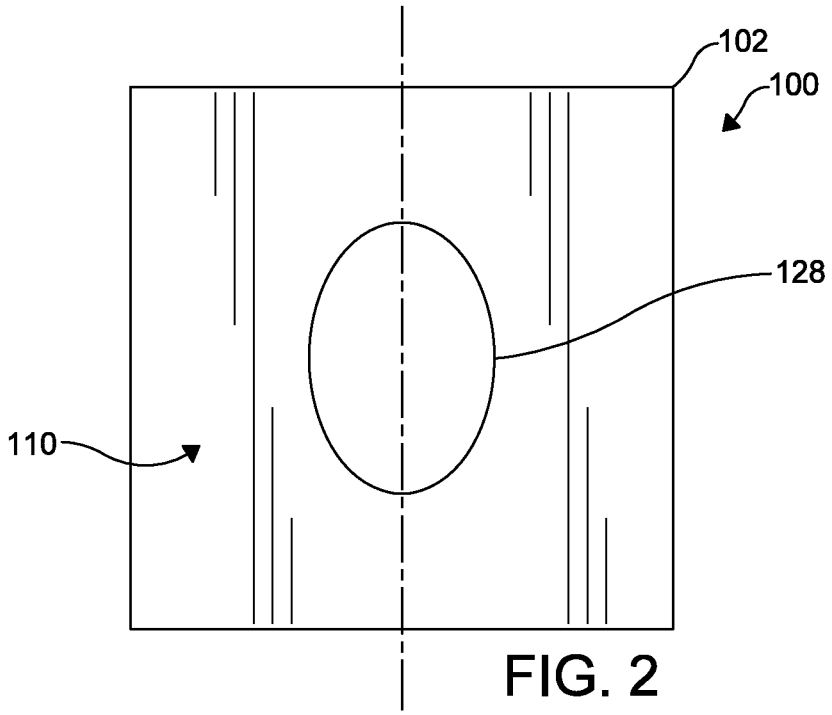
FIG. 2 is a top plan view of the combination dispensing and disposal container shown in FIG. 1.
Figure 3:
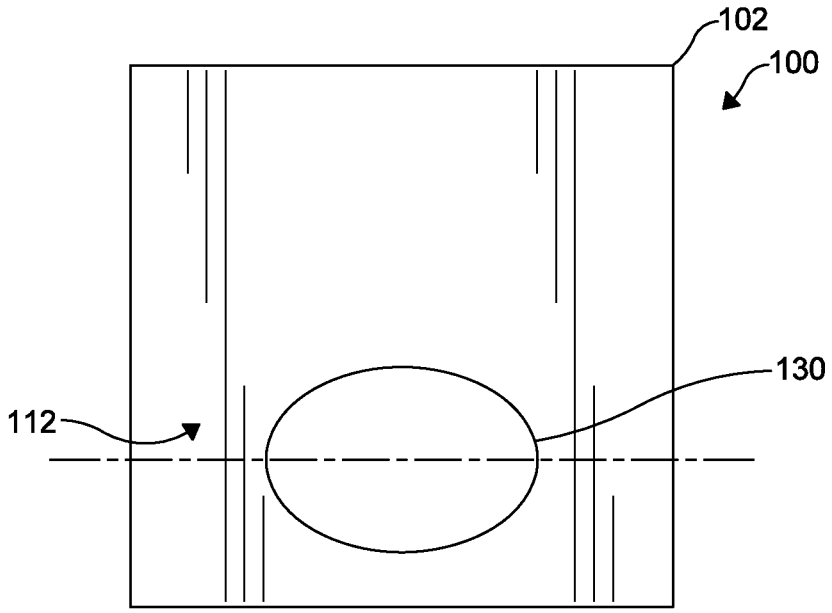
FIG. 3 is a front elevational view of the combination dispensing and disposal container shown in FIG. 1.
Figure 4:
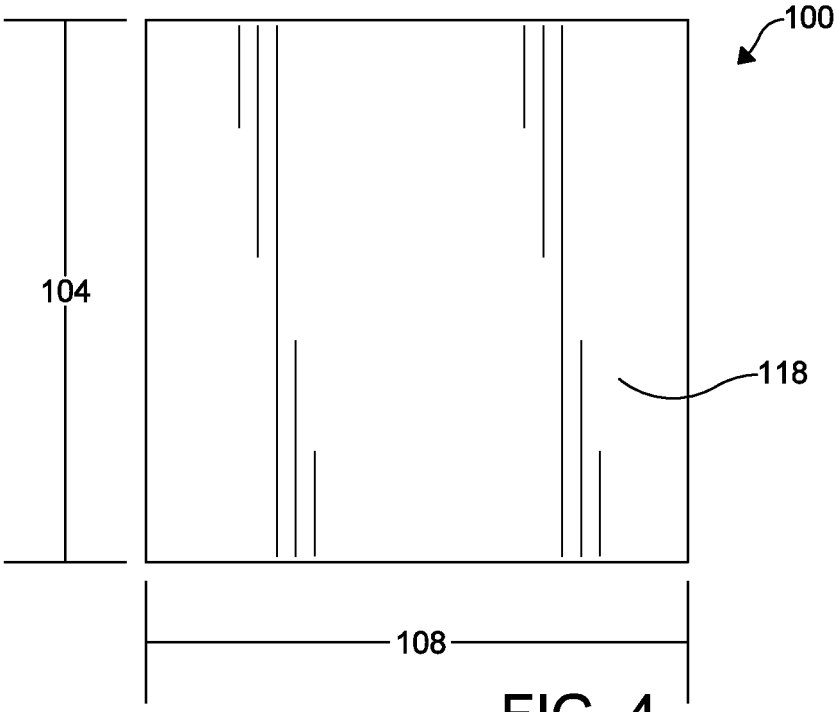
FIG. 4 is a right side elevational view of the combination dispensing and disposal container shown in FIG. 1.

As shown in FIG. 1-3, each of the dispensing opening 128 and the disposal opening 130 may be substantially ovoid in shape. Being substantially ovoid in shape, each of the dispensing opening 128 and the disposal opening 130 may also have a length that is greater than a width. As depicted in FIG. 1, an orientation of the dispensing opening 128 may likewise be different than an orientation of the disposal opening 130. Other suitable shapes and orientations for the dispensing opening 128 and the disposal opening 130 may also be selected by a skilled artisan, as desired.

Referring now to FIGS. 5 and 6, the at least one first side panel 118 may include a bottom side panel 132 and a partition support panel 134. The partition panel 122 is disposed between and connecting the bottom side panel 132 and the partition support panel 134. The bottom side panel 132 may be attached to the bottom panel 114, the partition panel 122 may be attached to the bottom side panel 132, and the partition support panel 134 may be attached to the partition panel 122. In particular examples, the partition panel 122 extends between the first side panel 118 and the second side panel 120. The partition panel 122 is spaced apart from the bottom panel 114 in order to separate the storage compartment 124 and the waste compartment 126. The partition panel 122 may likewise be employed to support items in the storage compartment 124, such as tissues 135. It should be appreciated that the storage compartment 124 may also be used for storing other items within the scope of the present disclosure.

As also shown in FIG. 5, the partition support panel 134 may be disposed adjacent the at least one second side panel 120 upon being folded. The partition support panel 134 may further have a free end 136. The free end 136 of the partition support panel 134 may abut an inner surface of the bottom panel 114 to support the partition panel 122 above the bottom panel 114. Advantageously, the bottom side panel 132 and the partition support panel 134 may together support the partition panel 122 and militate against it from collapsing into the waste compartment 126 when the storage compartment 124 is filled with items.

With continued reference to FIGS. 5 and 6, it should be appreciated that a height 138 of the bottom side panel 132 is less than the height 104 of the main body 102. The difference in the heights 104, 138 is necessary in order to form and separate the storage compartment 124 and the waste compartment 126 within the interior of the main body 102. A length 140 of the partition panel 122 may be the same as or less than the width 108 of the main body 102, so that the partition panel 122 may span the interior of the main body 102 from the at least one first side panel 118 to the at least one second side panel 120.

As shown in FIG. 6, in certain examples the first side panel 118 adjacent a side of the main body 102 where the partition support panel 134 is attached may have a length that spans an entirety of the length 104 of the main body 102, so as to cover an area where the partition support panel 134 is bent inwardly at the folding line toward the interior of the main body 102.

As also shown in FIGS. 5 and 6, a height 142 of the partition support panel 134 may similarly be substantially the same as the height 138 of the bottom side panel 132. It should be appreciated that the substantially same heights 138, 142 of the bottom side panel 132 and the partition support panel 134 permit for the orientation of the partition panel 122 substantially parallel with the bottom panel 114 and the top panel 110.

As shown in FIG. 6, the combination dispensing and disposal container 100 of the present disclosure may be constructed from a folding blank 150. The folding blank 150 upon being folded along the various folding lines shown in FIG. 6 to construct the combination dispensing and disposal container 100 may be affixed and held together with adhesives 152, as a non-limiting example. For example, the adhesive 152 may be double sided adhesive tape, glue, or a spray on adhesive; however, any adhesive may be chosen by a skilled artisan. In a most particular example, it should be appreciated that the partition support panel 134 may be affixed to an inner surface of the second side panel 120 with the adhesive 152 in order to provide for a robust positioning of the partition panel 122 within the interior of the main body 102. Other suitable means for affixing or holding the folding blank 150 in the folded form in order to construct the cuboid shape of the disposal container 100 may also be employed within the scope of the present disclosure.

Although the formation of the partition panel 122 using a single, one-piece folding blank 150 is contempalted and shown in FIG. 6, one of ordinary skill in the art may appreciate that the partition panel 122 may be formed in other ways within the scope of the present disclosure. For example, the partition panel 122 may be formed separately as a "shelf" and then inserted into the interior of the container 100 upon the container 100 itself being folded from the folding blank 150. The separately formed partition panel 122 may further be affixed with adhesive or mechanically so that it is spaced apart above the bottom panel 114, for example. Other suitable means for disposing the partition panel 122 within the container 100 are also contempalted and may be employed, as desired.

FIG. 7 illustrates an example flow diagram of a method 200, according to one embodiment of the present disclosure. The method 200 may include a step of providing the folding blank 150 configured to be folded to the cuboid shape at a first block 202. The method 200 may include a step of folding the partition panel 122 inwardly from an unfolded position so that the partition panel 122 is disposed between the top panel 110 and the bottom panel 114 at a second block 204. The method 200 may include a step of folding the partition support panel 134 downwardly from an unfolded position so that the partition support panel 134 is disposed adjacent the at least one second side panel 120 and abuts the bottom panel 114 to support the partition panel 122 above the bottom panel 114 at a third block 206. The method 200 may include a step of folding a remainder of the folding blank 150 to form the main body 102 into the cuboid shape at a fourth block 208. The method 200 may further include a step of affixing the partition support panel 134 to the inner surface of the second side panel 120 with the adhesive, for example, as shown in FIG. 5. Other suitable method steps and means for constructing the combination dispensing and disposal container 100 may also be employed within the scope of the present disclosure, as desired.

Advantageously, the combination dispensing and disposal container 100 of the present disclosure is usable for individual personal use, provides an all-in-one convenient box for separated new items form used items, and can be used anywhere. The entirety of the combination dispensing and disposal container 100 may also be discarded into the trash or recycled upon the disposal compartment being filled with used items.

While certain representative embodiments and details have been shown for purposes of illustrating the invention, it will be apparent to those skilled in the art that various changes may be made without departing from the scope of the disclosure, which is further described in the following appended claims.

What is claimed is:

1. A combination dispensing and disposal container, comprising:

a main body folded to a cuboid shape having a height, a length, and a width, the main body having a top panel, a front panel, a bottom panel, a rear panel, at least one first side panel, at least one second side panel, and a partition panel, the at least one first side panel including a bottom side panel and a partition support panel with a free end, the bottom side panel is coformed with the bottom panel, the partition panel attached to the bottom side panel, and the partition support panel is attached to the partition panel, the partition panel disposed between and connecting the bottom side panel and the partition support panel, the partition panel extending between an interior surface of the first side panel and an interior surface of the second side panel and spaced apart from the bottom panel, the partition support panel disposed adjacent the at least one second side panel, the partition support panel disposed adjacent an interior surface the at least one second side panel, the free end of the partition support panel abutting the bottom panel to support the partition panel above the bottom panel, the partition support panel affixed to the interior surface of the at least one second side panel with an adhesive, and the main body having a storage compartment and a waste compartment separated by the partition panel;

a dispensing opening formed in the top panel of the main body and in communication with the storage compartment, the dispensing opening permitting for a dispensing of new items from the storage compartment through the dispensing opening; and a disposal opening formed in the front panel of the main body and in communication with the waste compartment, the disposal opening permitting for a disposal of used items into the waste compartment through the disposal opening, wherein each of the dispensing opening and the disposal opening has a length greater than a width, and an orientation of the dispensing opening is different than an orientation of the disposal opening.

2. A folding blank for a combination dispensing and disposal container, comprising:

a main body configured to be folded to a cuboid shape, the main body having a top panel, a front panel, a bottom panel, a rear panel, at least one first side panel, at least one second side panel, and a partition panel, the at least one first side panel including a bottom side panel and a partition support panel with a free end, the bottom side panel is coformed with the bottom panel, the partition panel attached to the bottom side panel, and the partition support panel is attached to the partition panel, the partition panel configured to be disposed between and connecting the bottom side panel and the partition support panel, the partition panel extending between an interior surface of the first side panel and an interior surface of the second side panel and spaced apart from the bottom panel, the partition support panel configured to be disposed adjacent the at least one second side panel, the partition support panel configured to be disposed adjacent an interior surface the at least one second side panel, the free end of the partition support panel configured to abut the bottom panel to support the partition panel above the bottom panel, the partition support panel configured to be affixed to the interior surface of the at least one second side panel with an adhesive, and the main body configured to have a storage compartment and a waste compartment separated by the partition panel upon the main body being folded;

a dispensing opening formed in the top panel of the main body and configured to be in communication with the storage compartment upon the main body being folded, the dispensing opening permitting for a dispensing of new items from the storage compartment through the dispensing opening; and a disposal opening formed in the front panel of the main body and configured to be in communication with the waste compartment upon the main body being folded, the disposal opening permitting for a disposal of used items into the waste compartment through the disposal opening.

3. The combination dispensing and disposal container of claim 2, wherein a height of the bottom side panel is less than a height of the main body.

4. The combination dispensing and disposal container of claim 3, wherein a length of the partition panel is the same as or less than a width of the main body.

5. The combination dispensing and disposal container of claim 4, wherein a height of the partition support panel is substantially the same as the height of the bottom side panel.

6. A method for constructing a combination dispensing and disposal container, the method comprising steps of:

providing folding blank having a main body configured to be folded to a cuboid shape, the main body having a top panel, a front panel, a bottom panel, a rear panel, at least one first side panel, at least one second side panel, and a partition panel, the at least one first side panel including a bottom side panel and a partition support panel with a free end, the bottom side panel is coformed with the bottom panel, the partition panel attached to the bottom side panel, and the partition support panel is attached to the partition panel, the partition panel disposed between and connecting the bottom side panel and the partition support panel, the partition panel extending between an interior surface of the first side panel and an interior surface of the second side panel and spaced apart from the bottom panel, the partition support panel disposed adjacent the at least one second side panel, the partition support panel disposed adjacent an interior surface the at least one second side panel, the free end of the partition support panel abutting the bottom panel to support the partition panel above the bottom panel, and the main body configured to have a storage compartment and a waste compartment separated by the partition panel upon the main body being folded, a dispensing opening formed in the top panel of the main body and configured to be in communication with the storage compartment upon the main body being folded, the dispensing opening permitting for a dispensing of new items from the storage compartment through the dispensing opening, and a disposal opening formed in the front panel of the main body and configured to be in communication with the waste compartment upon the main body being folded, the disposal opening permitting for a disposal of used items into the waste compartment through the disposal opening, wherein the at least one first side panel includes a bottom side panel and a partition support panel, the partition panel disposed between and connecting the bottom side panel and the partition support panel;

folding the partition panel inwardly from an unfolded position so that the partition panel is disposed between the top panel and the bottom panel;

folding the partition support panel downwardly from an unfolded position so that the partition support panel is disposed adjacent second side panel and abuts the bottom panel to support the partition panel above the bottom panel; and folding a remainder of the folding blank to form the main body into the cuboid shape.

7. The method of claim 6, further comprising a step of affixing the partition support panel to an inner surface of the second side panel with an adhesive.

* * * * *